US006918582B2

(12) United States Patent
Dobbertin

(10) Patent No.: US 6,918,582 B2
(45) Date of Patent: Jul. 19, 2005

(54) SHEET FEEDER FOR A SHEET HANDLING MACHINE

(75) Inventor: Michael T. Dobbertin, Honeoye, NY (US)

(73) Assignee: Eastman Kodak Company, Rochester, NY (US)

( * ) Notice: Subject to any disclaimer, the term of this patent is extended or adjusted under 35 U.S.C. 154(b) by 120 days.

(21) Appl. No.: 10/668,404

(22) Filed: Sep. 23, 2003

(65) Prior Publication Data

US 2004/0061277 A1 Apr. 1, 2004

Related U.S. Application Data

(60) Provisional application No. 60/414,172, filed on Sep. 27, 2002.

(51) Int. Cl.[7] ..... B65H 3/08; B65H 3/12
(52) U.S. Cl. ..... 271/96; 271/108
(58) Field of Search ..... 271/96, 108

(56) References Cited

U.S. PATENT DOCUMENTS 5,072,922 A * 12/1991 Paulson ..... 271/99
5,213,320 A * 5/1993 Hirota et al. ..... 271/11
5,707,056 A * 1/1998 Rauen et al. ..... 271/96

* cited by examiner

*Primary Examiner*—Donald P. Walsh
*Assistant Examiner*—Kenneth W. Bower
(74) *Attorney, Agent, or Firm*—Kevin L. Leffel; Richard A. Romanchik

(57) ABSTRACT

A sheet feeder comprising a platform for stacking sheets and feed head assembly at the front of the platform for acquiring individual sheets from the stack and feeding separate sheets into a sheet handling machine. The feed head assembly is comprised of a vacuum plenum having a port plate, across which a perforated belt(s) moves in a closed loop. The port plate includes ports wherein the air flow through some of the ports is restricted by an intermediate plate positioned within the plenum which, in turn, has a restrictive passage therein through which air from the restricted ports must flow into the plenum.

11 Claims, 5 Drawing Sheets

SHEET FEEDER FOR A SHEET HANDLING MACHINE

FIELD OF THE INVENTION

The present invention relates to sheet feeding devices for sheet handling machines and in one of its aspects relates to vacuum-assisted, sheet feeder for a sheet handling device, e.g. a copier, printer, etc., having a means for controlling the air flow into vacuum plenum to alleviate misfeeds.

BACKGROUND OF THE INVENTION

A critical consideration in most sheet handling machines is the ability to rapidly feed individual documents through the machine, one at a time. For example, reproducing machines such as copiers, printers, and the like must include sheet feeding devices that are capable of rapidly and reliably feeding the individual sheets of a receiver medium (e.g. paper) through complex travel paths within the machine. For such a sheet-feeding device (i.e. sheet feeder) to be successful, it must be capable of operating at high transport speeds with only a minimum of downtime due to misfeeds or multifeeds (hereinafter collectively referred to as "misfeeds").

Sheet feeders are typically of two types; friction feeders and vacuum feeders. Friction feeders have been proven reliable for feeding individual sheets in many applications but, unfortunately, are susceptible to significant misfeeds when subjected to the harsher conditions normally found in higher speed copiers and printers. Vacuum feeders are more reliable for high-speed applications but require more precise control in reducing the number of misfeeds.

Some more recent sheet feeders have combined the positive aspects of both friction and vacuum sheet feeders in order to reduce misfeeds in high-speed machines; see U.S. Pat. No. 5,295,676, issued Mar. 22, 1994. In this feeder, a "bottom-feed" sheet feeder is disclosed wherein the bottommost sheet of a stack of individual sheets in a tray is engaged and is removed by one or more belts. At the same time, a vacuum is applied through the belts to acquire and maintain the sheet against the belts as the belts moves the sheet from the stack and feeds into the machine.

A similar approach is disclosed in U.S. Pat. No. 5,634,634, issued Jun. 3, 1997, wherein a "bottom-feed" sheet feeder is disclosed for handling sheets after a first pass through the duplex copier. This feeding mechanism includes a vacuum corrugated duplex tray, which receives and stacks the sheets after the first pass during which information has been copied onto one side of each sheet. The feeding mechanism then feeds the stacked sheets, one at a time, back off the tray for a second pass through the copier so that additional information can be copied onto the respective sheets. This combined approach has also been used in "top-feed" sheet feeders; see in U.S. Pat. No. 5,334,133, issued Sep. 4, 1994.

In sheet feeders, such as described in U.S. Pat. Nos. 5,634,634 and 5,334,133, cited above, one or more perforated belts move in a closed loop over a ported plate which, in turn, is in communication with a vacuum plenum. As will be understood in the art, when the holes in the belts align with the ports in the ported plate, the vacuum in the plenum acts through the aligned holes to attract and hold an individual sheet (i.e. the bottommost sheet of the stack, if the feeder is a "bottom feed" or the topmost sheet, if the feeder is a "top feed", hereinafter referred to as "acquired sheet") against the moving belts.

A surface within the respective tray or hopper, which holds the stack of individual sheets, is configured (i.e. corrugated) to aid in separating the acquired sheet from the stack. At the same time, a positive air stream is directed onto the front of the stack to further aid in separating the acquired sheet from the sheets remaining in the tray.

In feeders of this type, it is desirable to limit the air flow through the belts in order to control the "air bleed" through the sheets, themselves. This can be a real problem where the sheets are comprised of thin/porous materials or where the sheets have pre-punched holes or the like near the lead edges thereof. If the air "bleeds" through the acquired sheet (e.g. through the pre-punched holes therein), the forces generated thereby can, and often does, attract and hold a second sheet against the acquired sheet thereby resulting in a dreaded misfeed.

To alleviate this problem in the previous feeders, e.g. see U.S. Pat. No. 5,634,634, the ports in the vacuum plate are configured so that the flow of air into the plenum is restricted near the lead edge of the stack in the tray. That is, the ports adjacent the lead edge of the stack are made smaller than the other ports in the vacuum plate in order to minimize the air flow through the ports near the lead edge of the stack that may align with a hole or the like in the sheet and thereby reduce the attractive force on the sheets as they are acquired and moved by the belts.

Unfortunately, however, there still has to be vacuum area to tack the lead edge of the acquired sheet onto the belts. It has been found that, in order to do this, some of the smaller openings have to be enlarged (e.g. made triangular in shape) near the lead edge of the vacuum plate in order to insure that the holes in the belt near the lead edge are in communication with the vacuum plenum to provide the air flow (i.e. attractive force) needed to acquire and hold the lead edge of the acquired sheet against the belt during acquisition and removal.

While these known sheet feeders have been successful in most applications, problems with "air bleed" still exist, especially where the acquired sheet has pre-punched holes or the like near the lead edge thereof. While the smaller ports do limit the airflow near the lead edge, a real probability exists that, at some time, one or more of these ports (e.g. slightly larger, triangular ports) will directly align with a hole(s) in the belt and with a pre-punched hole(s) in the acquired sheet. If and when this occurs, the airflow through the belt can attract and acquire a "second" sheet in the stack thereby producing a misfeed. Further, the small ports used in this configuration are susceptible to becoming plugged with paper dust, etc. over long periods of operations which, in turn, can result in undesirable downtime of the machine.

SUMMARY OF THE INVENTION

The present invention provides a sheet feeder for use with a sheet-handling machine such as a copier, printer, or the like. The feeder has a tray, which is adapted to receive a stack of sheets of a copy medium (e.g. paper). The sheets are stacked in the tray and then are fed, one at a time, from the tray into the sheet-handling machine, as needed.

More specifically, the sheet feeder of the present invention is comprised of a platform for stacking the sheets thereon. A feed head assembly is positioned adjacent the front or lead side of the platform and is adapted to acquire an individual sheet from the stack and feed it off of the front edge of the platform.

The feed head assembly is comprised of a vacuum plenum, which is positioned towards the front of the platform. A port plate, which closes the plenum, is substantially aligned with the front of the platform and is substantially parallel to the stack of sheets on the platform. The port plate has a plurality of ports through which air can flow into the plenum to thereby establish a vacuum at the ports. These ports are preferably positioned in two sets wherein the ports in the first set, i.e. those nearest the front of the port plate, are smaller than the ports in the second set which, in turn, lies between the back of the port plate and the first set of ports. A means is provided within the plenum to restrict the airflow through the first set of ports to reduce the possibility of acquiring a second sheet when the desired sheet is acquired.

At least one belt having openings therethrough is mounted for movement through a closed loop around the vacuum plenum and across the port plate so that when openings in the belts align with any of the ports in the port plate, air will flow therethrough into the vacuum plenum to create a vacuum which, in turn, acquires individual sheet from the stack and tacks it against the belt. Movement of the belt then removes the acquired sheet from the stack and feeds it off the platform.

The means for restricting the flow of air through the first set of ports is preferably comprised of an intermediate plate positioned within the vacuum plenum. The intermediate plate has a restrictive passage (e.g. a tortuous passage) in fluid communication with the first set of ports in the port plate. A cap plate abuts the intermediate plate and has one or more openings therein which communicate with the restrictive passage through the intermediate plate. When a hole(s) in the belt aligns with a port(s) in the first set of ports, air can only reach the vacuum plenum through the restrictive passage and the small opening in the cap plate.

By limiting the air flow at the front of the platform, the possibility of acquiring second sheet is alleviated, especially in copying operations where sheets are used which have pre-punched holes in the margin (i.e. lead edge) thereof.

BRIEF DESCRIPTION OF THE DRAWINGS

The actual construction operation, and apparent advantages of the present invention will be better understood by referring to the drawings, not necessarily to scale, in which like numerals identify like parts and in which.

DESCRIPTION OF THE PREFERRED EMBODIMENTS

Figure 1:
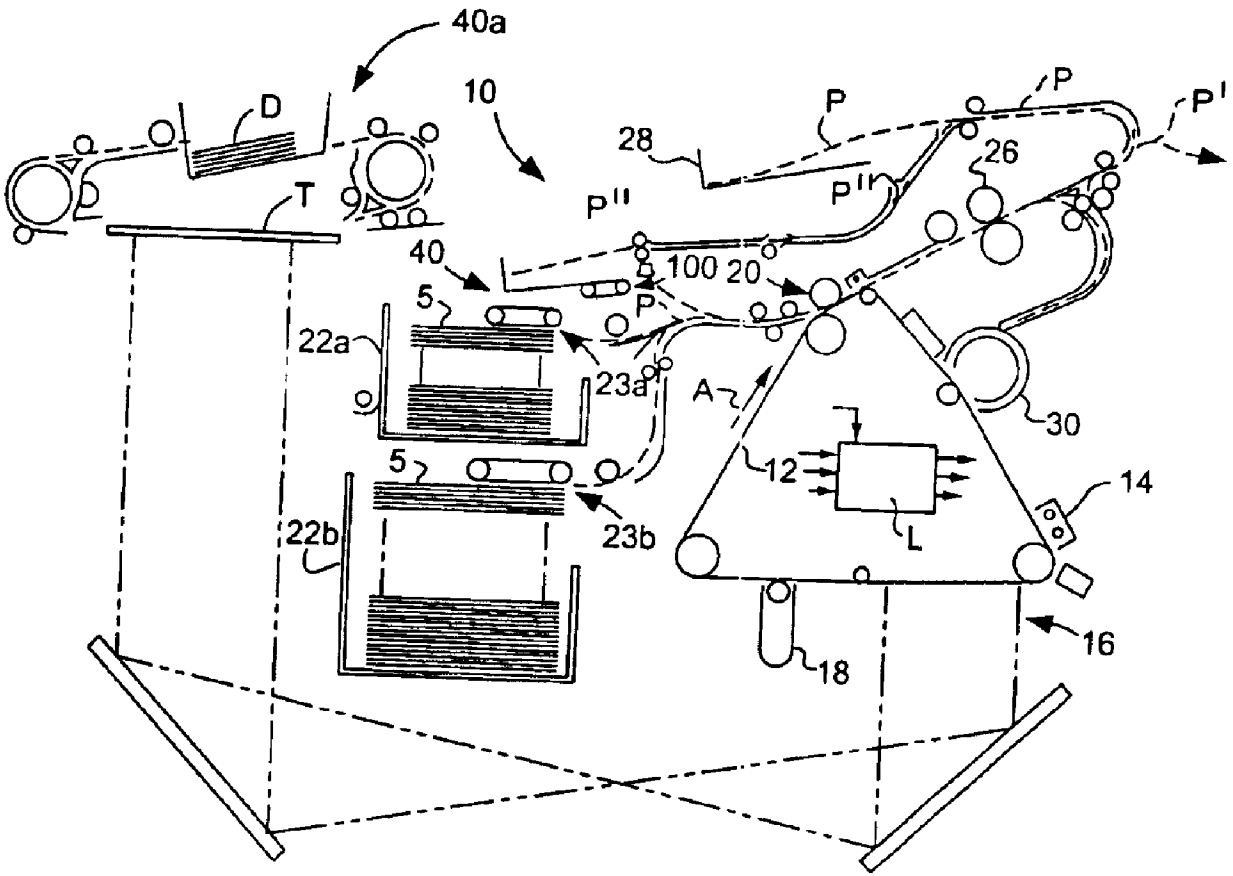
FIG. 1 is a schematic view of an electrophotographic apparatus (e.g. duplex copier/printer machine) in which the present invention may be incorporated.

Referring now to the drawings, FIG. 1 schematically illustrates a typical document handling machine 10 (e.g. duplex copier, duplicator, printer, etc.) which can utilize the "top-feed", sheet feeder and/or the "bottom-feed", sheet feeder of the present invention. As illustrated, machine 10 is a duplex copier of the type that uses an endless photoconductor member 12 (e.g. photographic film) to transfer an inputted image onto a sheet S of a copy medium. The film moves through a closed loop past a charging station 14 and then through an exposure or input station 16 where the charge is altered to form an image corresponding to the information to be reproduced (i.e. hereinafter "image"). The desired image may be formed by exposing the film 12 to light reflected off an original document D which, in turn, may be manually placed or automatically fed onto transparent platen T by a "bottom-feed" or a "top-feed", sheet feeder 40*a*.

Film 12 continues through developing station 18 where toner is applied to the image before the image is advanced to image transfer station 20. Coordinated therewith, a sheet S of a copy medium (e.g. paper) is fed from a supply hopper 22*a* or 22*b* (depending on size of sheet needed) by the respective "top-feed", sheet feeder 23*a*, 23*b*, into image transfer station 20 where the toner image on the film 11 is transferred to the sheet S. Sheet S is then fed along path P to a fuser section 26 where the toner image is fixed to sheet S by heat/pressure and then to an output hopper 28 for operator retrieval, or alternately, is moved along path P' to a finishing apparatus (not shown). Simultaneously, film 12 is cleaned of any residual toner by passing through clean/erase station 30. A logic and control unit L (e.g. microprocessor) is used to control the operation of the various stations as will be understood in the art.

In carrying out a duplex copying operation, sheets S are delivered via path P" to and are stacked in vacuum corrugated duplex tray 40 after an image has been copied onto one side thereof. Tray 40 then effectively becomes a "bottom-feed" sheet feeder 100 which selectively feeds the sheets, one at a time, back into path P upstream of the transfer station 20 for a second pass through machine 10 as will be understood in the art.

As pointed out above, the sheet feeder of the present invention may be a "top-feed" (e.g. feeders 23*a*, 23*b*) or can be a "bottom-feed" (e.g. 40, 40*a*). As will be recognized from the following descriptions of each of these types of feeders, the novel and inventive features of the present invention are applicable to both.

Figure 2:
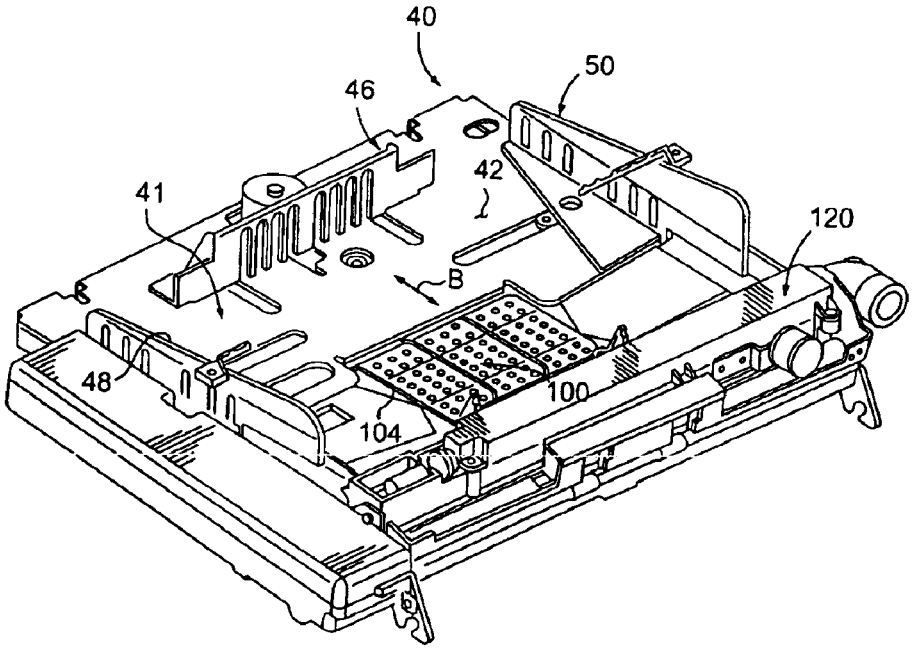
FIG. 2 is a perspective view of a bottom-feed, sheet feeder (i.e. duplex tray), which includes the present invention.
Figure 3:
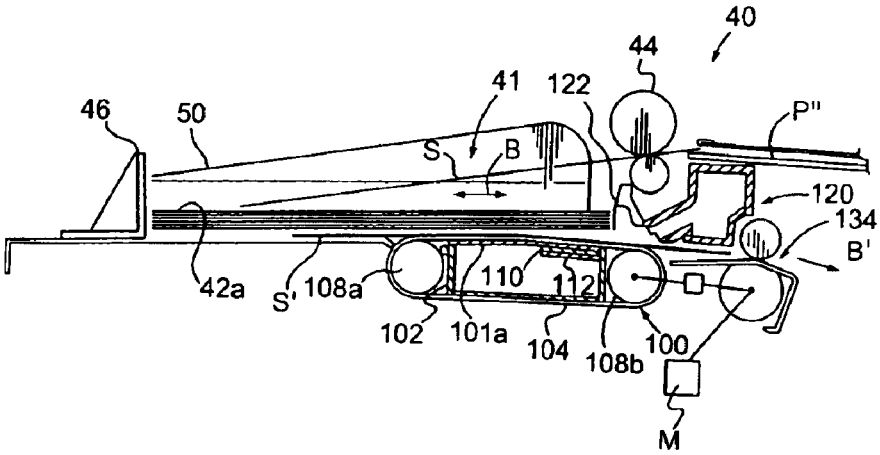
FIG. 3 is an enlarged, side elevational view, partly in section, of the bottom-feed, sheet feeder of FIG. 2.

A typical bottom-feed, sheet feeder 40 in accordance with the present invention is illustrated in FIGS. 2 and 3 which is comprised of a corrugated tray 41 having adjustable guides 46, 48, and 50 thereon. Tray 40 has a platform 42 for supporting a stack of individual sheets S. A feed head assembly 100 is located at the front of platform 42 and is adapted to feed sheets S, one at a time, from the bottom of the stack for a second pass through machine 10. Basically, feed head assembly 100 is comprised of a vacuum plenum 102, which is connected to a vacuum source (not shown), a belt transport mechanism 104, and an air jet device 120, which, in turn, is connected to a positive air source PS. The top of vacuum plenum 102 is closed with port plate 101, which will be described in greater detail below.

Figure 5:
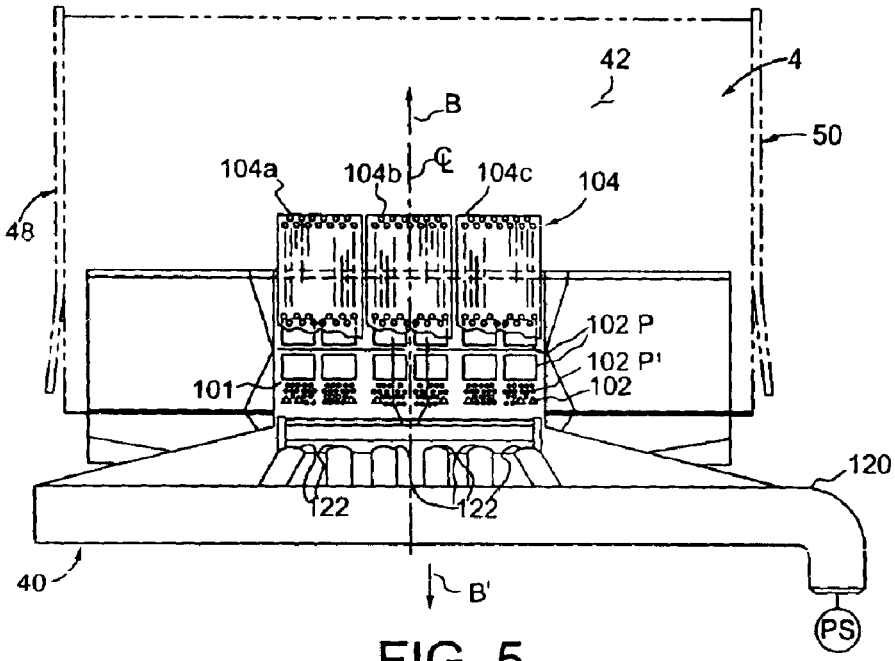
FIG. 5 (PRIOR ART)
FIG. 5 is a plan view of a sheet feeder, similar to that of FIGS. 2–4, with portions removed to facilitate viewing, showing a prior art configuration of the ports associated with the vacuum plenum of the feeder.

Belt transport mechanism 104 is comprised of one or more belts (three shown, 104*a*, 104*b*, 104*c*) entrained over rollers 108*a*, 108*b* (FIG. 3) to establish a closed loop path around plenum 102 and across port plate 101. The bottommost sheet S' in the stack is attracted by airflow through belts by the vacuum applied from plenum 102 through ports 102*p*, 102*p*' in port plate 101 (see FIG. 5, 5A) and is effectively tacked to the belts by vacuum force once the sheet covers the ports. The belts are driven in direction B to remove the bottommost sheet S' and deliver it to nip roller pair 134 which, in turn, is driven by motor M.

Figure 5A:
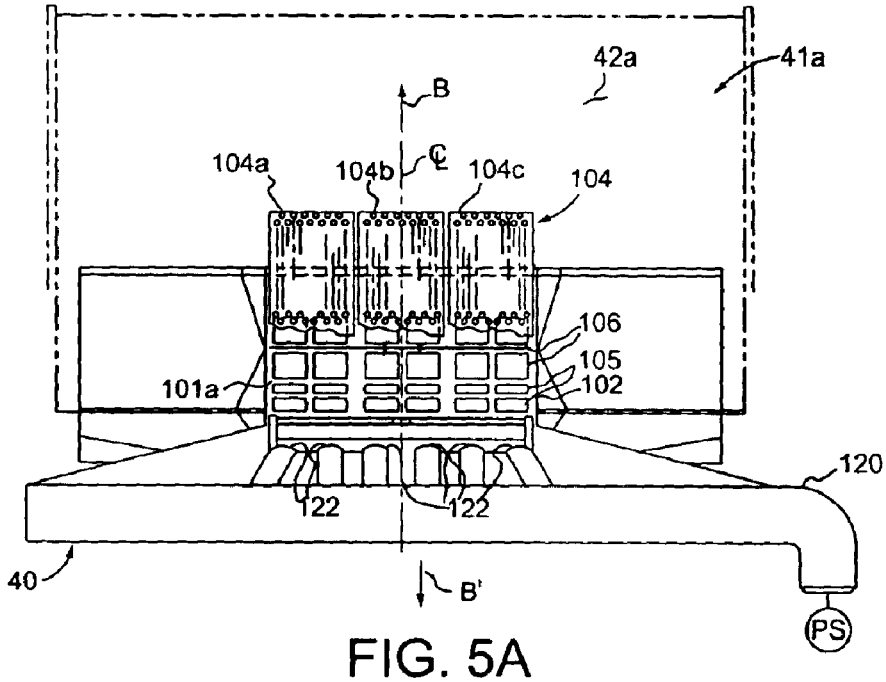
FIG. 5A is a top plan view of a sheet feeder, similar to FIG. 4, showing the configuration of the ports associated with the vacuum plenum in accordance with the present invention.

Air jet device 120 is comprised of a plurality of nozzles 122 (six shown in FIG. 5A) which are positioned so that air is directed onto the front of the stack to aid in separating the sheets as the acquired sheet S' is removed by the belt mechanism 104. The construction and operation of machine 10 to this point is basically the same as that shown and described in U.S. Pat. No. 5,634,634 which is hereby incorporated in its entirety by reference.

Figure 4:
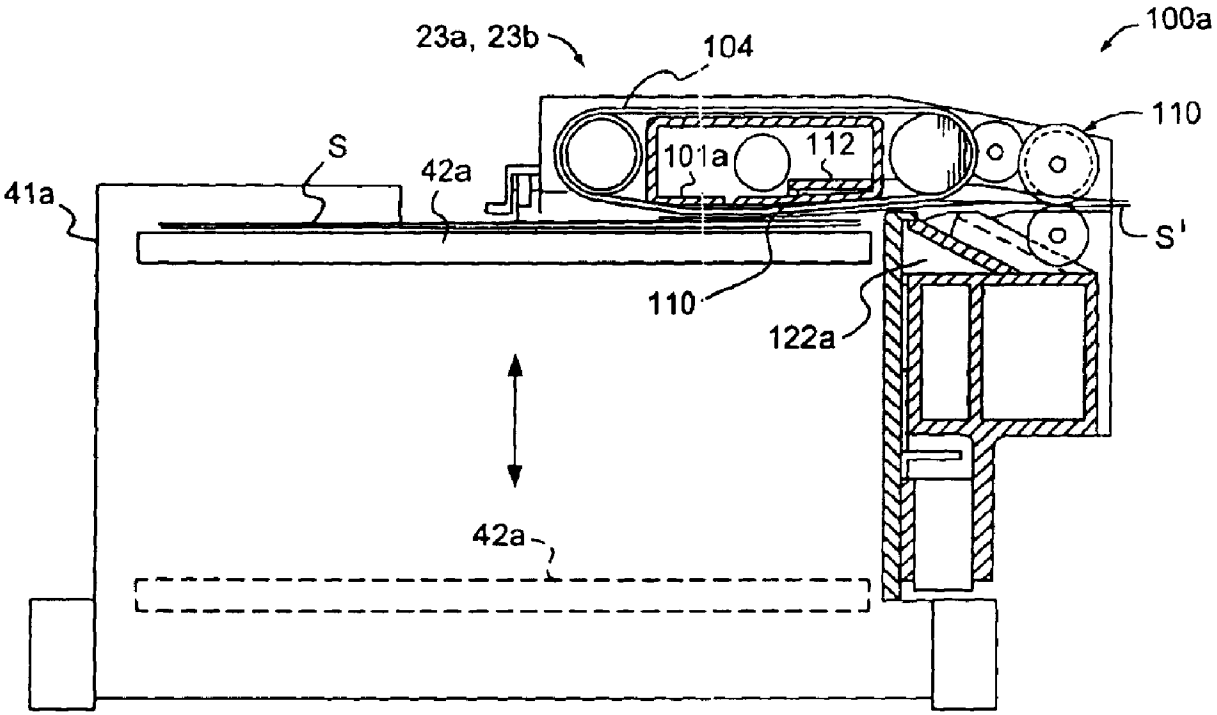
FIG. 4 is a side elevation view, partly in section, of a top-feed, sheet feeder which includes the present invention.

A typical top-feed, sheet feeder 23*a*, 23*b*, in accordance with the present invention, is best seen in FIG. 4. As illustrated, top-feed, sheet feeder 23*a*, 23*b* is comprised of a hopper or tray 41*a* having a movable platform 42*a* therein which, in turn, supports a stack of sheets S. Platform 42*a* is movable between its uppermost position (42*a* in solid lines) and its lowest position (42*a* in phantom lines) by any suitable mechanism (not shown). As will be understood in the art, platform 42*a* is raised as sheets S are fed from the stack on platform 42*a*.

A feed head assembly 100*a* is positioned towards the front of platform 42*a* and is adapted to feed sheets S, one at a time, from the top of the stack into document handling machine 10. Basically, feed head assembly 100 is comprised of a vacuum plenum 102*a*, which is connected to a vacuum source (not shown), a belt transport mechanism 104, and an air jet device 120*a*, which, in turn, is connected to a positive air source PS. The bottom of vacuum plenum 102*a* is closed with port plate 101*a*, which will be described in greater detail below.

Belt transport mechanism 104 is comprised of one or more belts, which move in a closed loop path around vacuum plenum 102*a* and across port, plate 101*a*. The top sheet S' in the stack is attracted by airflow through belts by the vacuum applied from plenum 102 through ports 102*p*, 102*p*' in port plate 101*a* (see FIG. 5, 5A) and is effectively tacked to the belts by vacuum force once the sheet covers the ports. The belts then deliver the top sheet S' to nip roller pair 110*a*.

Air jet device 120*a* is comprised of a plurality of nozzles 122*a* which are positioned so that air is directed onto the front of the stack to aid in separating the sheets as the acquired sheet S' is removed by the belt mechanism 104. The construction and operation top-feed, sheet feeder 23*a*, 23*b* to this point is basically the same as that shown and described in U.S. Pat. No. 5,5,344,133 which is hereby incorporated in its entirety by reference.

It order to optimize performance of feed mechanism 100,100*a*, it is necessary to balance three forces; i.e. (1) the attraction of the sheet to be fed during acquisition; (2) the attraction of the sheet during feeding after acquisition; and (3) the attraction of the next sheet in the stack. The design of the vacuum blower (not shown) affects the balance of the force provided to acquire the sheets relative to the force required after acquisition. This is accomplished by designing a blower that has the appropriate increase in vacuum static pressure as a result of the decreasing flow requirements once an acquired sheet blocks off the ports thereby balancing these forces. Ideally, the attraction of the acquired sheet is maximized during acquisition, the holding force on the acquired sheet is sufficient for reliable transport, and the attraction force for acquiring "second" sheets is minimized.

The design of primary port plate 101*a* can effect the balance of the attraction forces on the acquired sheet to be fed and on adjacent sheets in the stack, especially when the acquired sheet has pre-punched holes therein. That is, the size and shape of the ports near the front or lead edge of the stack (where the holes are typically located) are the most important. It is necessary to restrict the airflow through the ports in this area in order to minimize attraction of adjacent sheets while, at the same time, expose enough holes in the belts to vacuum plenum to provide adequate attraction for the acquired sheet. This is especially important when as the acquired sheet is fed into the air stream from jets 122, 122*a*.

The importance of limiting the air flow near the front of the port plate previously has been recognized and discussed in U.S. Pat. No. 5,634,634 (already incorporated herein by reference) which discloses a port plate 101 (present FIG. 4) wherein a first set of smaller openings or ports 102*p*' are provided near the front edge of plate 101 in front of a second set of larger openings 102*p*. The airflow through the small openings 102*p* is restricted thereby reducing the possibility of acquiring a second sheet as the acquired sheet S' is fed from the stack on platform 42.

However, to insure that adequate vacuum will be available at the first set of ports to acquire and retain the lead edge of the sheet against the belts during the initial acquisition of the sheet, larger triangularly-shaped openings are provided within the first set of ports 102 across the front edge of the prior art plate 101. While port plate 101 has been successful in most applications, the presence of the larger triangular ports near the front edge of platform 42 still present the possibility of misfeeds if and when a hole(s) in the belts aligns with both a triangular port 102 and a pre-punched hole or the like in the acquired sheet. The larger airflow through the triangular port is then free to act directly upon a second sheet to attract and remove a second sheet along with the originally acquired sheet.

Now returning now to the present invention, the feed head assembly 100 includes a port plate 101*a* (FIGS. 3, 5A, 6, and 7) which further alleviates the problems of misfeeds, especially when such misfeeds are primarily the result of pre-punched holes or the like in the sheets being used in machine 10. Port plate 101*a* effectively closes vacuum plenum 102, 102*a* and will lie substantially parallel to the sheets S in stack on platform 42, 42*a*.

Port plate 101*a* has a first set of ports 105 therethrough which are positioned near the front or lead edge of plate 101*a* and, as illustrated, are small rectangular-shaped openings which lie in parallel rows. A second set of ports 106 are provided through port plate 101*a* which lie between first set 105 and the back of port plate 101*a* and again, as illustrated, are larger rectangular-shaped openings which also lie in parallel rows.

The configuration of the sets of ports is important in that the vacuum applied through the first set of ports 105 near the front of port plate 101*a* must be adequate to tack the acquired sheet S' (FIGS. 3 and 4) to belts 104 when the sheet effectively covers the ports during movement of the belts. However, at the same time, the air flow through these ports 105 must be limited to a flow volume which is not sufficient to attract a second sheet when ports 105 are aligned with a pre-punched hole(s) or the like in sheet S'.

Figure 6:
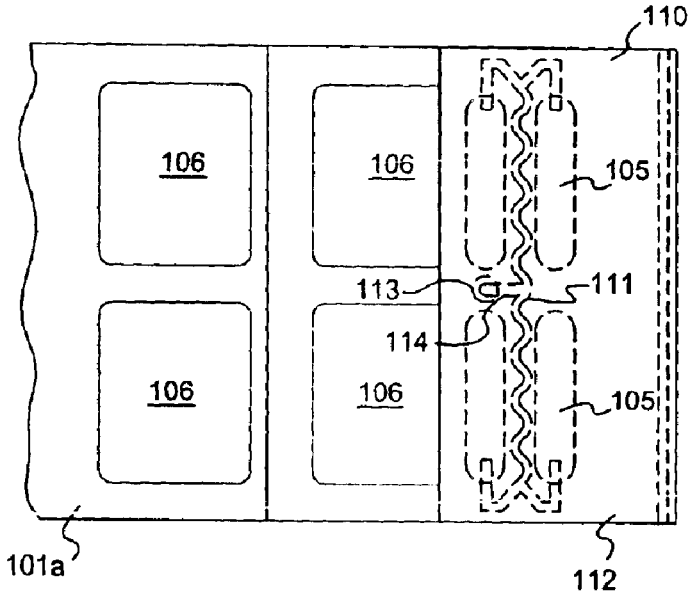
FIG. 6 is an enlarged top plan view of portion of the port plate of the present invention.
Figure 7:
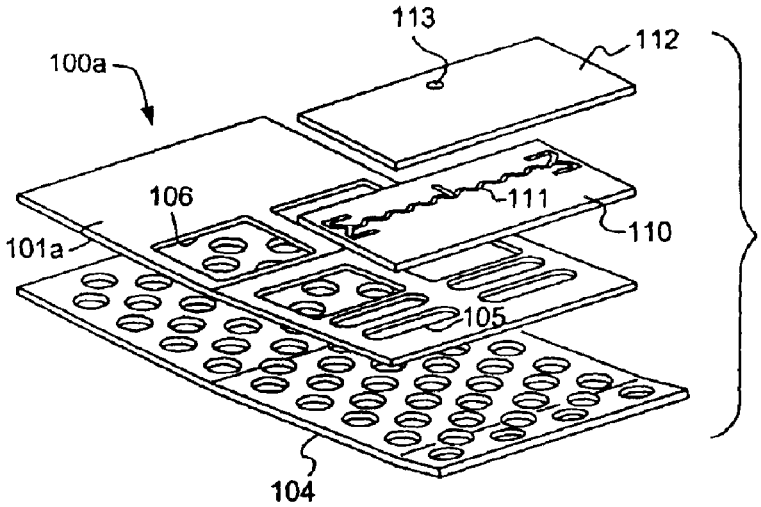
FIG. 7 is an exploded view of the principle components of the sheet feeder of the present invention; and While the invention will be described in connection with its preferred embodiments, it will be understood that this invention is not limited thereto. On the contrary, the invention is intended to cover all alternatives, modifications, and equivalents which may be included within the spirit and scope of the invention, as defined by the appended claims.

This is accomplished in the present invention by providing a means within the vacuum plenum 102 for restricting the airflow through the first set of ports 105. This air-resisting means is comprised of an intermediate plate 110, which is positioned within vacuum plenum 102 and abuts up against port plate 101*a* in substantially sealing engagement therewith. That is, there is substantially no flow of air between the plates 101*a* and 110. Intermediate plate 110 has a restrictive passage 111 therethrough which, as illustrated, is preferably a tortuous channel which, in turn, opens through intermediate plate 110 and extends substantially across the width of plate 110. The terminals of channel 111, as best seen in FIG. 6) are only in slight fluid communication with the first set of ports 105 which further restricts the amount of air that can flow from ports 105 through channel 111.

A cap plate 112 is positioned within plenum 102 and abuts against intermediate plate 110 in substantially sealing engagement therewith. Again, there is no substantial airflow between intermediate plate 110 and cap plate 112. Cap plate 112 has at least one port 113 therein which is in fluid communication with leg 113 of tortuous channel 111 in intermediate plate 110 whereby air flow through the first set of ports 105 can only flow into the plenum 102 through channel 111 and port 113 in cap plate 113. Since the larger, second set of ports 106 open directly into plenum 102, the vacuum applied through these ports is sufficient to keep the acquired sheet S' tacked to the belts.

In operation, the bottommost/topmost sheet S' (depending on whether tray 40 is a "bottom-feeder" or a "top-feeder") is acquired onto belts 104 as vacuum is applied through both sets of ports 105, 106 in port plate 101*a*. Tray as explained in U.S. Pat. No. 5,634,634, the corrugated shape of platform 42 contorts the acquired sheet and aid in separating it from the other sheets in stack 42*a*. Also, air jets 122 further aid in effecting the desired separation of the sheets.

As the sheet S' is moved forward by belts 104, the lead or front edge is pulled down (see FIG. 3) by the air flow through the first set of ports 105. This air flow is adequate to acquire and tack sheet S' to belts 104 as the belts remove sheet S' from the stack but, due to the restrictive air flow through ports 105, the air flow is insufficient to attract a second sheet even if a pre-punched hole passes over ports 105.

What is claimed is:

1. A sheet feeder for feeding individual sheets, one at a time, into a sheet handling machine, said sheet feeder comprising:

a platform having a front edge and a back edge for supporting a stack of said sheets; and a feed head assembly positioned adjacent said front edge of said platform and adapted to acquire an individual sheet from said stack and feed said acquired sheet off said front edge of said platform, said feed head assembly comprising:

a vacuum plenum positioned towards said front edge of said platform;

a port plate closing said vacuum plenum and positioned substantially parallel to said sheets in said stack on said platform, said port plate having a front edge substantially aligned with said front edge of said platform;

a plurality of spaced ports through said port plate through which air can flow into said plenum;

means within said plenum for restricting the air flow through some of said plurality of ports in said port plate; and at least one belt having openings therethrough mounted for movement through a closed loop around said vacuum plenum and across said port plate so that when openings in said at least one belt align with any of said plurality of spaced ports in said port plate, air can flow through the aligned holes in said belt and said spaced ports in said port plate to thereby acquire and remove the acquired sheet from said stack on said platform.

2. The sheet feeder of claim 1 wherein said means for restricting air flow through said ports comprises:

an intermediate plate positioned within said plenum and in abutment with said port plate, said intermediate plate having a restrictive passage therein which fluidly communicates said plenum with said some ports in said port plate having said restrictive air flow.

3. The sheet feeder of claim 2 including:

a cap plate positioned within said vacuum plenum and in abutment with said intermediate plate, said cap plate having at least one port therethrough, which fluidly communicates said plenum with said restrictive passage in said intermediate plate.

4. The sheet feeder of claim 3 wherein said restrictive passage in said intermediate plate is a tortuous channel through said intermediate plate and extending along a portion of the width of said intermediate plate.

5. The sheet feeder of claim 4 wherein said tortuous channel is in fluid communication with said at least one hole in said cap plate and with said ports in said port plate having said restrictive air flow.

6. The sheet feeder of claim 5 wherein said some ports having restrictive air flow are smaller that said remainder of said ports in said port plate.

7. The sheet feeder of claim 6 including:

an air jet directed onto the front of said stack on said platform to aid in separating said acquired sheet from the remainder of said sheets in said stack.

8. The sheet feeder of claim 5 wherein said ports in said port plate are comprised of a first set of rectangular openings positioned towards said back of said port plate and a second set of smaller rectangular openings positioned between said first set of openings and said front of said port plate.

9. The sheet feeder of claim 1 wherein said at least one belt comprises:

a plurality of belts positioned parallel to each other.

10. The sheet feeder of claim 1 wherein said sheet feeder is a top-feed, sheet feeder.

11. The sheet feeder of claim 1 wherein said sheet feeder is a bottom-feed sheet feeder.

* * * * *